United States Patent [19]

Takahasi et al.

[11] 3,956,755

[45] May 11, 1976

[54] ELECTROSTATIC IMAGE FORMING METHOD AND APPARATUS WITH CONTROLLED DISCHARGE OF THE ORIGINAL MEMBER

[75] Inventors: Isoji Takahasi; Seiji Matsumoto, both of Asaka, Japan

[73] Assignee: Fuji Photo Film Co., Ltd., Japan

[22] Filed: June 25, 1974

[21] Appl. No.: 483,063

[30] Foreign Application Priority Data

Aug. 10, 1973 Japan ..... 48-89869

[52] U.S. Cl. ..... 346/74 ES; 346/74 EH

[51] Int. Cl.[2] ..... G03G 15/052

[58] Field of Search ..... 346/74 ES, 74 S, 74 SB, 346/74 EL; 178/6.6 A, 30

[56] References Cited

UNITED STATES PATENTS

| | | | |
|---|---|---|---|
| 2,817,598 | 12/1957 | Hayford | 346/74 ES |
| 3,329,962 | 7/1967 | Cola | 346/74 ES |
| 3,585,061 | 6/1971 | Allinger | 346/74 ES |
| 3,723,645 | 3/1973 | Takami | 346/74 ES |

*Primary Examiner*—Bernard Konick
*Assistant Examiner*—Jay P. Lucas
*Attorney, Agent, or Firm*—Gerald J. Ferguson, Jr.; Joseph J. Baker

[57] ABSTRACT

An electrostatic image forming method, which comprises uniformly charging the surface of an electrostatic image forming material comprising both (1) surface portions each having an insulating surface and on the surface of an insulating support in a pattern-like manner and (2) conductive layer portions each having a conductive surface and formed on the remaining areas of the surface of the insulating support in a manner that the conductive layer portions are electrically isolated from the earth, grounding the surface of the charged conductive layer portions to the earth with a potential difference being maintained which prevents a possible discharge from occuring between the conductive layer portions, which are being grounded and which are to be grounded, thereby removing the charges from the charged conductive layer portions so that the charges in the surfaces of the insulating surface portions remain forming the latent electrostatic image; and an electrostatic image forming apparatus including in addition to a corona charger and a grounding means, a time delay means interposed between the conductive layer portions and the earth for effecting the potential difference maintenance.

11 Claims, 14 Drawing Figures

FIG. 1a
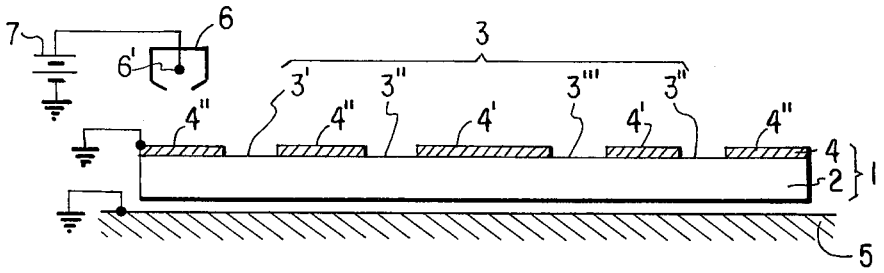
FIG. 1b
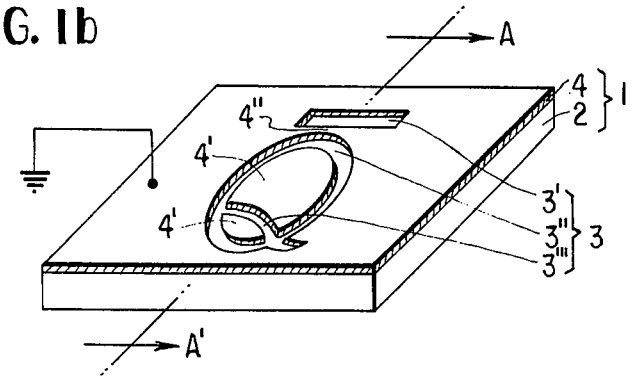
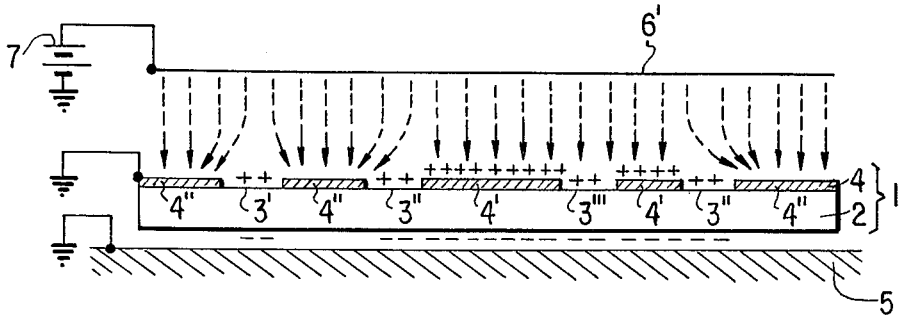
FIG. 2

FIG. 3
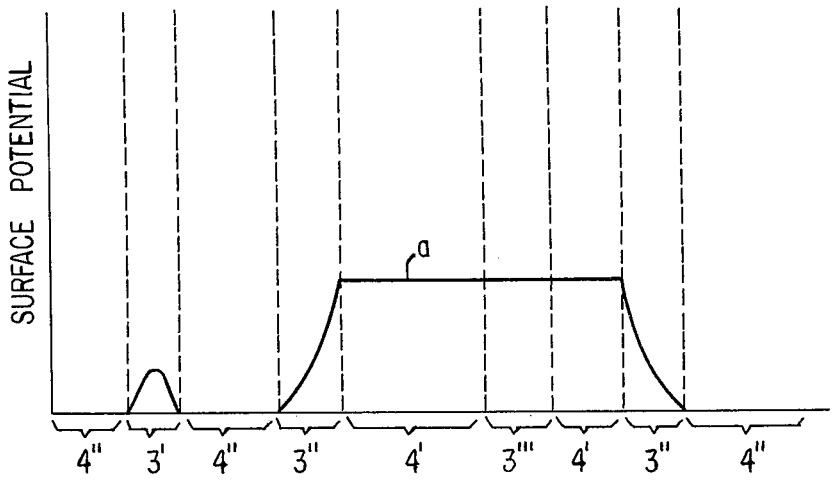
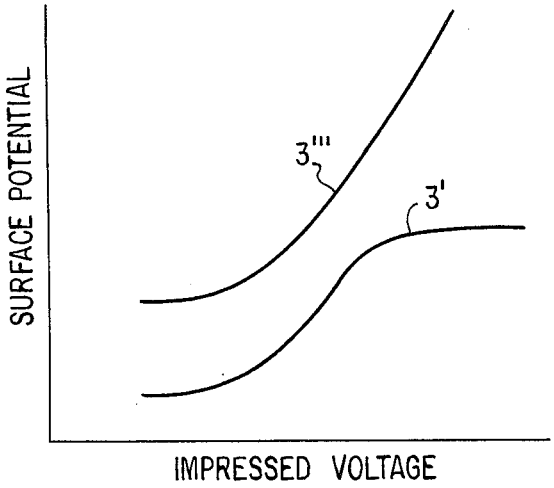
FIG. 4

FIG. 9
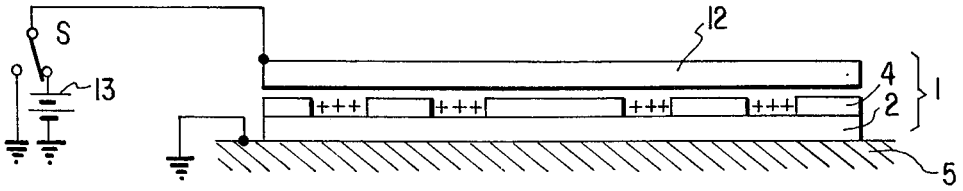
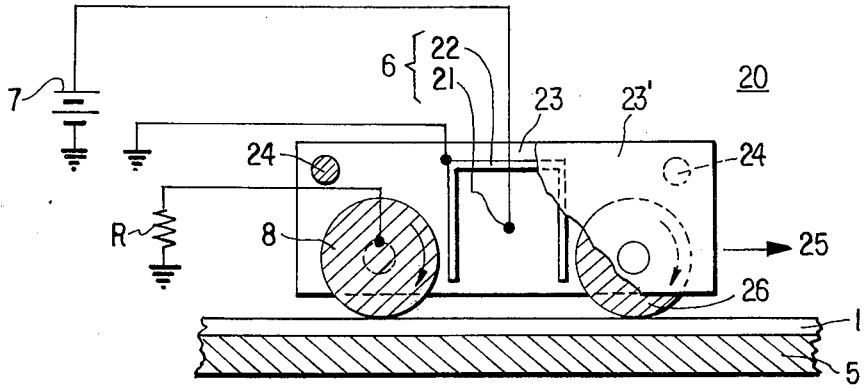
FIG. 10
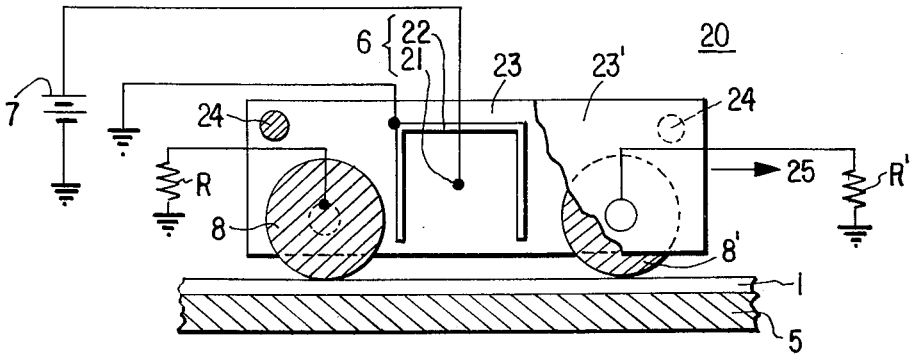
FIG. 11

FIG. 12
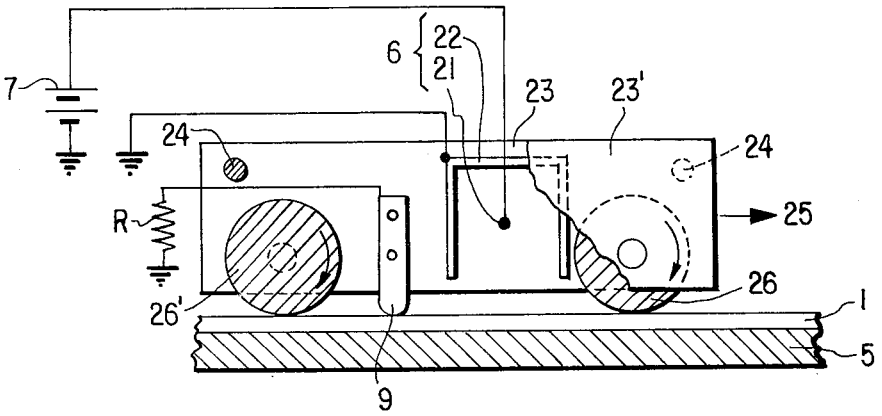
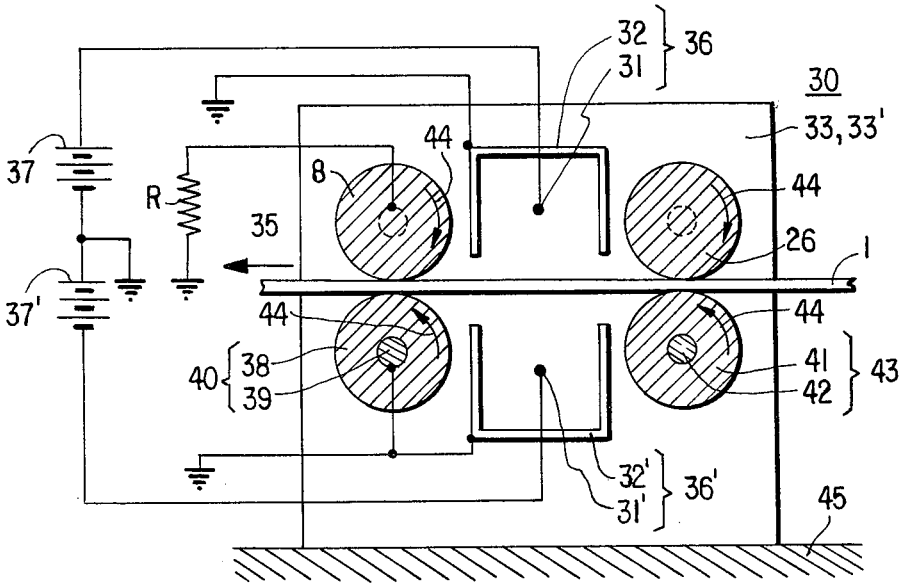
FIG. 13

ELECTROSTATIC IMAGE FORMING METHOD AND APPARATUS WITH CONTROLLED DISCHARGE OF THE ORIGINAL MEMBER

BACKGROUND OF THE INVENTION

1. Field of the Invention

The present invention relates to an electrostatic image forming method, and more particularly, to a method of forming an electrostatic image on insulating surface portions, which are formed in a pattern-like manner on an electrostatic image forming material, together with conductive layer portions, and to an apparatus therefor.

2. Description of the Prior Art

In the electrostatic image printing field, charging the insulating surface portions in addition to the insulating layer portions on an electrostatic image forming material has been widely accomplished. In this conventional method, more specifically, the electrostatic image forming material, on which the conductive layer portions and the insulating surface portions are distributed in a pattern-like manner, is placed on a conductive base plate. Then, charges are applied to the insulating portions, for instance, using a corona charging process, with the conductive portions being grounded to the earth, thus forming the desired electrostatic image.

Where an electrostatic image forming material which has a conductive intermediate layer formed on an insulating support and insulating layer portions formed on the conductive intermediate layer in a pattern-like manner is used in the conventional method, it is easy to ground the conductive layer to the earth with satisfactory results.

On the other hand, another method has been proposed, in which an image forming material which has conductive layer portions and insulating surface portions both distributed in a pattern-like manner is used, thus dispensing with the conductive intermediate layer on the insulating support.

In accordance with the above method, a method has been proposed, in which a conductive layer capable of being peeled off is formed on the surface of an insulating support. Desired portions of the conductive layer are then removed in a pattern-like manner using a stencil pen or the like so as to form recessed and exposed insulating surface portions on the surface of the insulating support. Charges are applied to the engraved insulating surface portions using a corona charging process or the like to thereby form a desired electrostatic image thereon.

In this method, moreover, when the electrostatic image on the insulating surface portions is intended to be transferred by applying toners thereto, the toner image obtained is formed on the engraved surface portions, so that the toner image will scarelly be damaged even if registration in the transfer operation is carried out. Therefore, this method is quite important in obtaining satisfactory transfer quality.

However, the method, in which the corona charging process is applied to the electrostatic image forming material formed with the conductive layer portions and with the insulating surface portions without the formation of the conductive intermediate layer on the insulating surface, is inevitably accompanied by the following drawbacks.

Reference will now be made to FIGS. 1 to 4 of the accompanying drawings. In FIG. 1*a*, reference numeral

1 indicates an electrostatic image forming material (which will be referred to hereinafter, for brevity, as a "material"), which is composed of conductive layer portions 4 in which at least the surface is conductive and formed on an insulating support 2 and of insulating surface portions 3 formed in a pattern-like manner on the insulating support 2. The insulating surface portions 3 are formed in such a fashion that a conductive layer 4, which is formed on the surface of the insulating support 2 to constitute the conductive layer portions 4, is removed in a pattern-like manner mechanically or chemically so as to expose the desired surface portions to the outside.

For illustrative purposes only, the insulating surface portions 3 are shown in FIG. 1b to have a shape of a modified letter "Q̄". In this case where the letter "Q̄" is engraved, the insulating surface portions 3 are divided into the following portions:

a. The portion 3' which is surrounded by conductive layer portion 4'' around the letter;

b. The portion 3'' which is surrounded both by the conductive layer portion 4'' and by island-shaped conductive layer portions 4' electrically isolated from the portion 4''; and c. The portion 3''' which is surrounded both by the portion 4'' and by the portions 4'.

The "material" 1 as above is placed on a conductive base plate 5, which is grounded to the earth as shown in FIG. 1*a*, with its back face down. A corona charging process is then carried out by moving a corona charger 6, which is connected with a power source 7 and whose corona electrode 6' is impressed with a high DC voltage, above the "material" 1 in the direction of the arrow. If the conductive layer portion 4'' around the letter "Q̄" is grounded to the earth in the manner as shown in FIGS. 1*a* and 1*b*, the charging operation is effected by the following actions.

At an initial stage of the charging operation, the corona ions are substantially uniformly applied to the surface of the "material". When the charging operation proceeds, the electric field of the "material" will reach the condition as shown in FIG. 2. In FIG. 2, the broken line arrows will indicate the behavior of the corona ions irradiated from the electrode 6' of the corona charger 6.

Among the ions thus uniformly applied, the ions applied to the surrounding conductive layer portion 4'' will be neutralized because the portion 4'' is grounded to the earth, whereas the ions applied to the insulating surface portions 3 and the island layer portions 4' will be stored temporarily therein as shown by the plus signs. The ions thus stored will exhibit a blocking action to succeeding corona ions, which are approaching to be applied to the "material" as shown by the broken line arrows. These charges establishing the blocking or repulsing electric field will be referred to, for brevity, as "blocking charges". Especially, the ions, which are approaching the vicinity of the insulating surface portions 3' and 3'' having both of its sides or one of its sides grounded to the earth, will be subjected to the repulsive force of the ions having the "blocking charges " and accordingly will charge their courses such that they will be caught by the conductive layer portion 4'' and neutralized.

On the contrary, the ions, which are approaching both the conductive island layer portions 4' electrically isolated from the surrounding layer portion 4'' and the insulating surface portion 3''' surrounded by the portions 4′, will be further trapped therein because they are separated from the grounded conductive layer portions 4″ and accordingly because they cannot leak thereto. The trapping or storing action of the charges will continue until they build up sufficiently as "blocking charges" against corona ions coming, or until an equilibrium condition is attained with the potential of the electrode 6′ of the corona charger 6. As a result, the charges stored in the conductive island layer portions 4′ and in the insulating surface portion 3‴ surrounded thereby will be increased to raise the potentials of the portions 4′ and 3‴. On the other hand, as these potentials become higher and higher increasing their repulsive forces, it becomes more and more difficult for corona charges to approach the insulating surface portion 3″, which are defined both by the conductive island layer portions 4′ and by the grounded conductive layer portion 4″.

The charges thus obtained are illustrated in FIG. 3 in terms of the distribution of the surface potentials.

In FIG. 3, the abscissa is taken from the A – A crossection of FIG. 1*b*, and the ordinate indicates the surface potentials of the respective portions. As shown, the potential in the grounded conductive layer portion 4″ surrounding the letter "Q" is zero, and the potentials in the conductive island layer portions 4′ isolated from the layer portion 4″ have a certain level because the charges impinging upon the layer portions 4′are temporarily stored therein and cannot leak to the layer portion 4″.

That portion 3′ of the insulating surface portions 3 forming the electrostatic image, which is surrounded by the grounded conductive layer portion 4″, has certain potential at its center, but this potential decreases in value toward the periphery until it becomes zero at its peripheral edges. This is because, during the charging operation, the ions leak to the conductive layer portion 4″ which is grounded to the earth. On the other hand, in the insulating surface portion 3″ which is defined by the conductive island layer portions 4′ and by the grounded conductive layer portion 4″, the coming corona ions are repulsed by the blocking voltage of the conductive island portions 4′, so that the surface portions 3″ have a potential of the certain level at the periphery of the island portions 4′ but a potential which decreased toward the periphery of the grounded conductive layer portion 4″ until it becomes zero at the peripheral edge of the portion 4″. On the contrary, the insulating surface portion 3‴, which is srrounded by the conductive island layer portions 4′, has a uniform potential of the certain level.

As shown in FIG. 3, the level of the uniform potential of the insulating surface portion 3‴ is much higher than the maximum level of the insulating surface portion 3′, which is surrounded by the conductive layer portion 4″. This is confirmed by the experimental results, as shown in FIG. 4. FIG. 4 is a graphical presentation, in which the surface potentials both of the insulating surface portion 3′ surrounded by the grounded conductive layer portion 4″ and of the insulating surface portion 3‴ defined by the conductive island layer portions 4′ are plotted against the impressed voltage. The potential of the insulating surface portion 3′ is, as can be understood from this graph, saturated at a certain level. On the contrary, the potential of the insulating surface portion 3‴ defined by the conductive island layer portions 4′ is increased continuously with an increase in the impressed voltage of the corona charging operation.

As is apparent from the foregoing descriptions, the following disadvantages will arise, in the case where an electrostatic image is formed in the insulating surface portions of an electrostatic image forming material which has electrically isolated conductive layer portions on its surface.

First of all, the electrostatic image obtained has a limited low potential. This means that a visual image of high density cannot be obtained after the electrostatic image is developed.

Secondly, the distribution of the charges in the insulating surface portions forming the electrostatic image cannot be made uniform. This phenomenon results from the fact that the potential at the peripheral edge of the insulating surface portion adjoining the conductive layer portion will have a low level. After having been subjected to a developing treatment, the electrostatic image thus obtained cannot produce a clear visual image of high contrast.

Thirdly, the potential of the insulating surface portion will have different levels depending upon whether the conductive layer portions surrounding the insulating surface portions are grounded or not. The electrostatic image thus obtained will produce a nonuniformity in the visual image.

In this connection, it has been proposed in Japanese Pat. No. 43-14846 that all of the island portions be grounded to materially eliminate the island-shaped conductive layer portions.

According to this proposal, a conductive fine net pattern is formed before or after the formation of an insulating image on and in contact with the conductive layer portions so as to eliminate the island-shaped conductive layer portions. In this method, therefore, if the charging operation is carried out with any point of the conductive layer portions being grounded, then the charges, which are temporarily stored in the conductive layer portions as a result of the impingement of the corona ions, are neutralized to form an electrostatic image corresponding to the insulating image. However, this method has the following inherent drawbacks, that is:

a. The electrostatic image obtained is often damaged partially by the net pattern and becomes difficult to read out;

b. Since commonly such island-shaped conductive layer portions of various sizes are formed in a mixed way, the net pattern has to be produced with meshes of smaller size than that of the smallest conductive layer portion so that the smallest portion may be electrically connected with adjacent portions. From a technical standpoint, the electrostatic image obtainable is inevitably divided into elements which are so excessively fine that they become difficult to read;

c. An additional step for forming the net pattern is inevitably incorporated; and d. as has been discussed as the first disadvantage of the conventional method, the potential of the electrostatic image obtained cannot be made sufficiently high with a charging operation of a predetermined quantity.

A novel method as disclosed in U.S. Pat. application Ser. No. 482,869, filed June 25, 1974 simultaneously herewith has been developed which can form a uniform and dense electrostatic image on the image portions of the insulating surface without being accompanied by the above-itemized drawbacks, even with use of a material whose conductive layer portions are isolated from each other by insulating surface portions. This electrostatic image forming method comprises: uniformly charging the surface of an electrostatic image forming material having on its surface both (1) image portions each having an insulating surface and (2) non-image portions each having a conductive surface, in a manner that the conductive non-image portions are electrically isolated from the earth; and then eliminating the charges from the conductive non-image portions.

The present invention is directed to an improvement in this method described above. More specifically, where a plurality of conductive layer portions, which are isolated from each other, are not subjected simultaneously to a grounding operation after they are charged, a condition will arise in which some of them are grounded while others are not. As a result of this condition, a steep potential gradient is established between the grounded conductive layer portions having a zero potential and the conductive layer portions left ungrounded and having a high potential due to the applied corona ions. If the gradient is quite large in this instance, "atmospheric discharge" or "creepage discharge" will take place between the grounded conductive layer portions and the ungrounded conductive layer portions. Under this particular conduction, it is possible that the charges, which are stored in the insulating surface portions, might be induced by the discharge between the conductive layer portions to accomplish their own discharge to such an extent that their potentials are lost, thus damaging a portion of the electrostatic image obtainable.

SUMMARY OF THE INVENTION

In view of the conventional drawbacks, it is therefore an object of the present invention to provide an improved method for forming an electrostatic image, in which the foregoing disadvantages are completely obviated, and to provide an apparatus therefore.

Another object of the present invention is to provide an improved electrostatic image forming method and an apparatus of the above type, in which the electrostatic image is formed on the insulating surface portions which in turn are formed in a desired pattern-like manner on an electrostatic image forming material together with the remaining conductive layer portions.

According to one aspect of the present invention, an electrostatic image forming method is provided which comprises: uniformly charging the surface of an electrostatic image forming material comprising both (1) surface portions each having an insulating surface and occupying the surface of an insulating support in a pattern-like manner and (2) layer portions each having a conductive surface and formed on the remaining areas of the surface of the insulating support, such that the conductive layer portions are electrically isolated from the earth; and grounding the surfaces of the charged conductive layer portions to the earth with a potential difference being maintained which prevents a possible discharge from occuring between the conductive layer portions which are being grounded the conductive layer portions which are to be grounded, so as to remove the charges therefrom so that the charges in the surfaces of the insulating surface portions remain as the electrostatic image.

According to another aspect of the present invention, an electrostatic image forming apparatus is provided comprising: a corona charger movable to relatively scan the surface of the electrostatic image forming material so as to uniformly charge the surface of the electrostatic image forming material with the conductive layer portions of the electrostatic image forming material being electrically isolated from the earth; a grounding means arranged behind the corona charger with respect to the moving direction of the corona charger and following the corona whereby the embossed conductive layer portions are contacted to thereby form a circuit grounding these layer portions to the earth; and a time delay means in the grounding circuit interposed between the conductive layer portions and the earth for maintaining during the grounding operation a potential difference which prevents a possible discharge from occuring between the conductive layer portions which are being grounded and the conductive layer portions which are to be grounded, whereby the charges in the conductive layer portions are removed therefrom so that the charges in the surfaces of the insulating surface portions remain forming the electrostatic image.

BRIEF DESCRIPTION OF THE DRAWINGS

These and other objects and advantages of the present invention will become apparent from the following description taken in conjuction with the accompanying drawings.

FIGS. 1*a*, 1*b* and 2 are explanatory views showing the prior-art method for forming an electrostatic image.

FIG. 3 is a graphical presentation showing the potential distribution of the charges on the electrostatic image forming material.

FIG. 4 is also a graphical presentation showing the surface potential which is built up by the impressed corona voltage on the surface portions to form the desired electrostatic image.

FIGS. 5 to 9 are side elevations showing the steps of the method according to the present invention, in which FIG. 5 illustrates the charging step whereas FIGS. 6 to 9 represent the respective examples of the grounding step.

FIGS. 10 to 13 are longitudinal sections showing an electrostatic image forming apparatus putting the present invention into actual practice.

DESCRIPTION OF PREFERRED EMBODIMENTS

Figure 5:
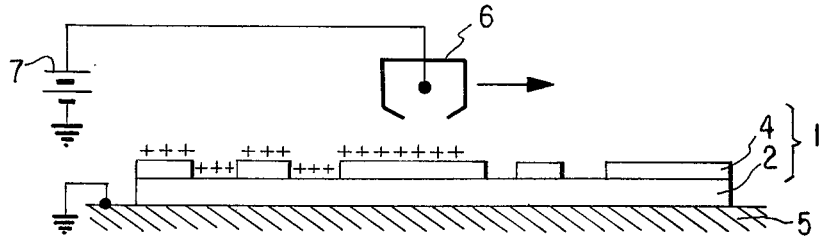

The present invention will now be described in detail with reference to the accompanying drawings. As shown in FIG. 1*b*, the electrostatic image forming material 1 used in the present invention is composed of conductive layer portions 4 and of an insulating support 2, least whose surface is conductive. This insulating support 2 is made of a highly insulating material including a film- and plate-shaped resin, paper, natural rubber, a ceramic plate and a glass plate. The insulating resin can be polyethylene, rigid polyvinyl chloride, plasticized polyvinyl chloride, polyamide such as nylon, polystyrene, polypropylene, polyester, polycarbonate, polyvinylidene chloride, methacrylic resin, acrylic resin, phenol resin, urea resin, silicone resin, and triacetyl cellulose. A material composed of a material having a relatively low specific resistance, for example, a metal plate or a metal foil, and of a highly insulating material of the above resin or the like covering the former material, can be used as the electrostatic image forming material. The surface resistance desirably is higher than $10^{12}$ Ω/□.

The conductive layer portions 4 can be made of a thin film of a metal, such as, copper, tin, zinc, aluminium, palladium, silver or gold, an alloy of these metals or a conductive oxide such as tin oxide.

Alternatively, the portions 4 can also be made of binder, in which the fine particles of the above metal or alloy such as powders of metals such as aluminium, copper, silver, gold, iron and alloys thereof, or carbon powders such as carbon black, graft carbon, etc. Suitable thermoplastic materials are rosin and the esters thereof, hydrogenated rosin and the esters thereof damar, copal, aliphatic petroleum hydrocarbon resins, substituted styrene copolymers such as cumarone indene resin, styrene copolymers, vinyl toluene, α-methylstyrene, polystyrene olefin copolymers, polystyrene-alkylmethacrylate copolymers, expoxy resins, alkyd resins, silicone resins, epoxyesters, polyalkylacrylates, polyalkylmethacrylates, phenolformaldehyde resins, etc. Suitable organic solvent soluble resins are natural resins and synthetic resins such as rosin and the esters thereof, hydrogenated rosin and the esters thereof, damar, coumaroneidene resins, aliphatic petroleum hydrocarbon resins, polystyrene, styrene-olefin copolymers, silicone resins, alkyd resins, epoxy resins, epoxyesters, polyalkylacrylates, polyalkylmethacrylates, styrene-alkylmethacrylate copolymers, etc. Binders which are thermoplastic or which dissovle in an organic solvent are preferred.

A paper at least the surface of which has been rendered conductive can also be employed.

The surface resistance of these portions 4 desirably is lower than $10^{10}$ Ω/□. Reference numeral 3 designates image forming portions of an insulating nature, which are formed by removing the conductive layer portions 4 in a desired pattern-like manner. These image forming portions 3 can be made by subjecting the conductive layer portions 4 to chemical etching, by scribing the same using a stencil pen, or by any suitable conventional means in depending upon the nature of the conductive layer portions 4 to be removed. A suitable chemical method which can be employed involves in general, masking the conductive layer on the insulating support and contacting the uncovered are as with a solvent which dissolves the conductive layer. This leaves the conductive layer only at those parts where there was no cover on the conductive layer, and the conductive layer is removed at the areas due to the mask with the insulating support being exposed. A suitable mechanical method involves simply the scratching away or abrading off of the conductive layer using mechanical methods such as removal employing a metal pen or stylus to expose the insulating support. Alternatively, the areas of the conductive layer (such as a vacuum evaporated thin aluminium film) which are to be removed can be removed using a laser beam. As an additional technique, the conductive areas desired can be formed by selectively adhering a conductive layer or surface to the insulating support. As shown, the letter "Q" is formed, by way of example only, as the insulating image forming portions 3. As to the depth of these image forming portions 3, it has been found experimentally that a depth of greater than 5 μ brings about desirable results. Reference numerals 4′ designate island-shaped conductive layer portions, which are electrically isolated by the insulating image forming portions 3 from the surrounding conductive layer portions 4″.

The electrostatic image forming material used in the present invention can have a construction other than that shown in FIGS. 1*a* and 1*b*, in which the embossed layer portions have conductive surfaces whereas the engraved surface portions are insulating. For example, as shown in FIGS. 1*a* and 1*b*, an intermediate layer, which is capable of being peeled off, is interposed between the insulating support 2 and the conductive layer portions 4, and the engraved image forming portions are formed by removing the conductive layer portion in a desired pattern-like manner together with the added intermediate layer.

Figure 6:
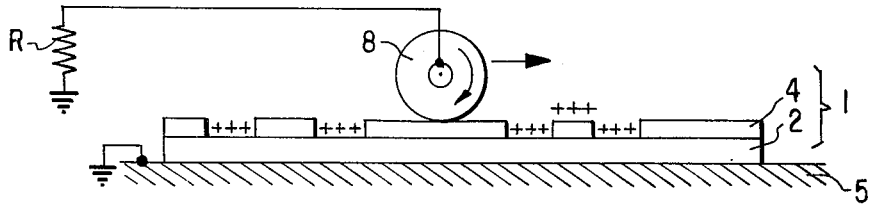

Turning now to FIGS. 5 and 6, one embodiment of the successive steps of the present invention is shown, in which FIG. 5 illustrates the charging step and FIG. 6 illustrates the grounding step of the charges in the conductive layer portions. The electrostatic image forming material 1 is placed on the grounded conductive base plate 5, which is shown in the longitudinal section A – A′ in FIG. 1*b*, with the back face of its insulating support down. In this instance, therefore, the conductive layer portions 4 are held at an isolated condition from the earth. At the next stage, for example, the corona charger 6, upon which a high DC voltage of a positive polarity is impressed, is moved in the direction of the arrow so that the entire surface of the electrostatic image forming material 1 is uniformly charged. Here, reference numeral 7 indicates a high DC voltage power source.

Although the corona charger 6 of FIG. 5 is impressed with a high DC voltage, it is quite natural that a pulsating high voltage of high frequency can be applied to the corona charger so as to obtain a stable corona charging operation.

Then, a rigid and conductive roller 8, which is grounded to the earth by way of a resistor R as shown in FIG. 6, is made to turn in contact in the direction of the arrows on the electrostatic image forming material 1, to which the charges have been applied in the charging step as shown in FIG. 5. As a result, the charges remaining in the conductive layer portions 4 can leak to the earth by way of the roller 8 and the resistor R.

In this instance, the leakage of the charges is delayed slightly by a parameter which is determined by *r*, R and C where *r* designates the resistance of the conductive layer portions 4, and C designates the capacity between the conductive layer portions and the earth. As a result, the conductive layer portions apart from the contact points between the conductive layer portions and the roller 8 can still have charges of a certian potential. If, therefore, the level of the resistance R is so determined that an attenuation speed slower than that of movement of the roller 8 is achieved, the potential difference between the island-shaped conductive layer portions, which remain ungrounded, and the conductive layer portions, which are grounded through the resistor R, can be minimized, and accordingly a possible discharge in between can be minimized.

Experimentally, it has been found that a resistance R ranging from about $10^5$ to $10^9$Ω can produce an electrostatic image without any damage due to discharge between the respective conductive layer portions. With a resistance higher than about $10^9$Ω, the flow of the charges is so greatly delayed that the conductive layer portions still retain considerable charges, even after they have been subjected to the grounding treatment, thus failing to produce an electrostatic image correctly corresponding to the pattern of the insulating image forming portions.

The roller 8 can be made of a metal steel including copper, aluminum, iron, brass, stainless steel and duralumin, or of an alloy of the metal. The roller can also be made of a resin roller of polyvinyl chloride, a polyvinylacetal resin known under the trade name of "Delrin", an acrylic resin or the like, on which a layer of the above metal is mounted.

Figure 7:
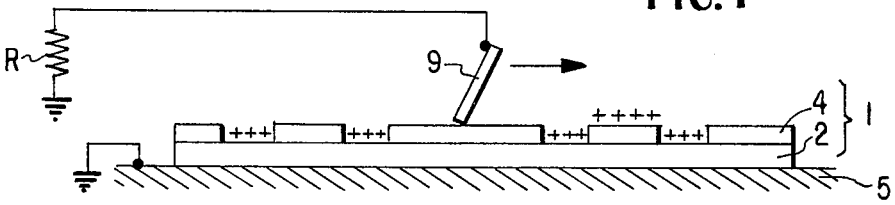

In FIG. 7 illustrating still another embodiment of the grounding step, a blade 9, which is grounded to the earth by way of the resistor R, is moved in the direction of the arrow for grounding purposes. This blade 9 is made of a material similar to that of the roller 8 as shown in FIG. 6. In this manner, the present invention can also be put into actual practice with similar results to those of the embodiment of FIG. 6.

Figure 8:
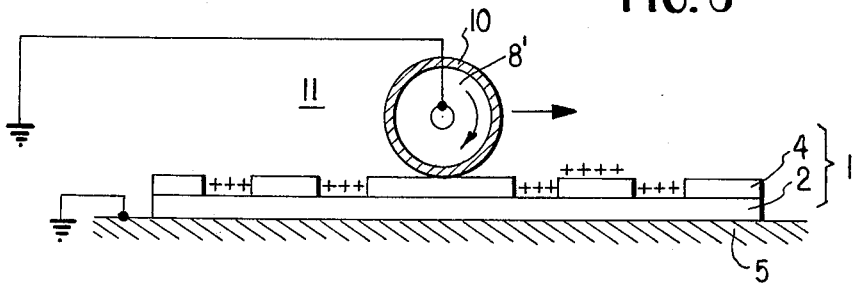

In FIG. 8, a further embodiment of the grounding step is illustrated, in which a roller 11 having a roller core 8' covered with a resistive layer 10 is used. Similar results can also be obtained from this embodiment. It is desirable that the resistive layer 10 have a resistance of about $10^5$ to $10^9\Omega$ under the condition that the roller core 8' is in contact with the conductive layer portions 4.

This resistance is determined both by the thickness of the resistive layer and by the contact areas between the roller core 8' and the conductive layer portions. For instance, if the roller 11 is so designed that the resistive layer has a thickness of 100 $\mu$ and the contact areas inbetween have a value of 1 $cm^2$, then a suitable level for the volume resistivity ranges from about $10^8$ to $10^{11}\Omega$ $cm^2$.

The roller core 8' can be made, for example, of a similar material to that of the roller 8 or FIG. 6, and the overlying resistive layer 10 can be made either by dispersing conductive fine particles such as those of copper, aluminium, silver, tin, zinc or carbon into a suitable insulating binder such as formaldehyde resins, epoxy resins, acryl resins, cumaroneindene resins, aliphatic petroleum hydrocarbon resins, polystyrene styreneolefin copolymers, silicone resins, alkyd resins, epoxy-ester resins, polyacrylacrylates, etc., to have a volume resistivity of about $10^8$ to $10^{11}\Omega$ $cm^2$, or by a metal oxide such as the oxides of aluminium, copper, iron, silver, tin, etc., if the roller 8' is made of the metal.

This construction of the roller is inevitably complicated slightly, but it is advantageous for the purpose of protecting the electrostatic image obtainable, because the passages for the grounded currents of the conductive layer portions are not limited to a single resistor. Moreover, it is advantageous in that the contact areas between the roller and conductive layer portions can be varied in accordance with the areas of the island-shaped portions thereof, and accordingly in that the total resistance is varied with the variation in the contact areas. Still moreover, the possible discharge between the charged image forming portions and the surface of the roller can be decreased to a considerable extent, because the roller is formed on its surface with the resistive layer.

Reference will now be made to FIG. 9, in which a further example of the grounding step is illustrated. As shown, a grounding plate 12, upon which a bias voltage having a potential substantially the same as that of the conductive layer portions 4, is placed on the conductive layer portions 4 for purpose of grounding. The grounding plate 12 is connected with a bias power source 13 by way of a switch S. When the grounding plate 12 is placed on the conductive layer portions 4, the possible discharge between the conductive layer portions 4 can be obviated, because as they are even if the grounding plate 12 is not brought into simultaneous contact with all of the layer portions which are isolated from each other. In the next stage, the switch S is switched to the side of the terminal which is grounded to the earth, and the charges in the respective conductive layer portions are allowed as a result to leak to the earth by way of the grounding plate 12 and the switch S.

In this manner, an electrostatic image without any damgae can be obtained. The grounding plate 12 can be made of a material similar to that of the roller 8 as showm in FIG. 6. It goes without saying that the switch S and the bias power source 13 can be replaced by a bias power source of a variable voltage type.

The bias voltage impressed upon the grounding plate desirably has a potential substantially equal to that of the conductive layer portions 4, but the level need not be limited to an equal value if it can prevent the possible discharge between the isolated conductive layer portions when the grounding plate is contacted with layer portions. A suitable bias voltage ranges from about 200 V to 2000 V.

Moreover, it will be apparent from the foregoing explanation that a resistor having resistance of about $10^5$ to $10^9\Omega$ can be used in place of the switch S and the bias power source 13.

In the above descriptions, on the other hand, the grounding method has been explained exclusively for a material on whose surface engraved insulating surface portions and embossed conductive layer portions are formed, but any material can be used in the present invention a pattern-like formation of conductive portions and insulating portions exists.

Turning now to FIG. 10, an apparatus exemplifying the present invention is shown in simplified longitudinal section. Reference numeral 1 indicates an electrostatic image forming material, which is prepared, as shown in FIGS. 1*a* and 1*b*, by forming a conductive layer 4 on an insulating support 2 and later by peeling off the conductive layer 4 in a pattern-like manner so as to form the desired image forming portions 3.

This electrostatic image forming material 1 is placed on the grounded conductive base plate 5 with insulating support of the "material" down. Reference numeral 20 indicates a charging head, which includes at least the corona charger 6, a pair of side plates 23 and 23', the grounded conductive roller 8 and an insulating roller 26.

This corona charger 6 is composed at least of a wire-shaped corona electrode 21 and of a grounded shield 22. The corona electrode 21 is made, for example, of a piece of metal wire having a diameter of about 20 to 200 $\mu$, such as, tungsten, molybdenum, stainless steel or brass, and is connected to a positive terminal of a high DC voltage power source 7 having an output voltage of about 5 to 20 KV. On the other hand, the shield case 22 is made, for instance, of an aluminium alloy plate or a zinc-plated steel plate. The corona charger 6 is thus held by the side plates 23 and 23'.

The grounding roller 8 is of a type whose surface at least is conductive and is grounded by suitable means to the earth by way of a resistor R. This roller 8 has a rigid surface and can be made of a metal including copper, aluminium, iron, brass, stainless steel and duralumin or of an alloy thereof. Alternatively, the roller 8 can be made of a synthetic resin roller, which can be made of polyvinyl chloride, Delrin, an acrylic resin, a fluorine-containing resin or a phenol resin, is covered with a thin film of the above metal or its alloy or of a film which is composed of a suitable binder and of carbon dispersed thereinto.

The insulating roller 26 at least has an insulating surface, and is made of a similar synthetic resin material to that of the grounding roller 8 or of a metal or alloy roller covered with a suitable insulating layer. Both the grounding roller 8 and the insulating roller 26 are rotatably held by the paired side plates 23 and 23'.

These side plates 23 and 23' and shafts 24 regulating the positions of the plates 23 and 23' can be made of a metal including copper, iron, aluminium, brass, stainless steel and duralumin or of an alloy of these metals. These members 23, 23' and 24 can also be made of a synthetic resin such as polyvinyl chloride, Delrin, an acrylic resin, a fluorine-containing resin or a phenol resin. In the case where the side plates 23 and 23' are rendered conductive, it is necessary that they be electrically isolated from the grounding roller 8 and/or the shield 22.

The charging head 20 is moved in the direction of arrow 25 by a suitable driving means (not shown). Alternatively, the electrostatic image forming material 1 and the conductive base plate 5 can be moved in the opposite direction to the arrow 25 with respect to the charging head 20, which is then made stationary. The corona ions, which are emitted from the corona electrode 21, are paritally caught by the embossed conductive layer portions and the engraved insulating image forming portions both formed on the surface of the electrostatic image forming material 1. The corona ions, which are temporarily stored in the image forming portions, remain trapped for charging the same, whereas the corona ions, which are temporarily stored in the conductive layer portions, are neutralized by the grounding roller 8 which is grounded to the earth by way of the resistor R. This neutralization is carried out through the resistor R, and accordingly the grounding is conducted progressively, as has been detailed in conjuction with FIG. 6. In this manner, the potential difference between the conductive layer portions, which are in contact with the grounding roller 8 and which are electrically isolated from the former to be grounded, can be made a relatively low level, so that the undesirable discharge in between can be eliminated. Thus, a clear electrostic image can be obtained without any damage.

Reference will now be made to FIG. 11, in which another embodiment exemplifying the present invention is illustrated in longitudinal section. In this embodiment, a second grounding roller 8', which is grounded to the earth by way of the resistor R, is provided in place of the insulating roller 26 of FIG. 10. The remaining elements are similar to those of FIG. 10, and accordingly a repetition of their description is omitted here.

The resistance levels of the resistors R and R' are so determined that the value of the equation $R \times R'/R + R'$ is about $10^5$ to $10^9\Omega$.

The second grounding roller 8' is also grounded to the earth by way of a resistor R' in a similar manner to that of the first grounding roller 8 but is isolated from other elements.

According to this embodiment, an electrostatic image exactly the same as that of the embodiment of FIG. 10 can be obtained without any damage.

In this embodiment, moreover, even if the resistance R' is made infinite and the second grounding roller 8' is electrically isolated from the earth, an electrostatic image without any damage can be obtained. In this instance, a resistance value of about $10^5$ to $10^9\Omega$ is sufficient for the resistance of the resistor R.

Although the foregoing embodiments have been directed to embodiments where a grounding roller 8 is employed, the roller 8 can apparently be replaced by the blade 9 of FIG. 7. This embodiment will be described in connection with FIG. 12, in which the blade 9 is interposed between an insulating roller 26' and the corona charger 6 substantially at the same level as those of the lowest portions of the rollers 26 and 26'. It is desirable that the blade 9 have a sufficient breadth.

Reference will now be made to FIG. 13, in which another specific embodiment of the present invention is illustrated in longitudinal section. Reference numeral 30 designates an electrostatic image forming apparatus, which includes at least one pair of corona chargers 36 and 36', two pairs of rollers 8 and 40, and 26 and 43, one pair of side plates 33 and 33' (although the side plate 33' is not shown), and a not-shown but suitable roller driving source. The corona chargers 36 and 36' are composed, respectively, at least of corona electrodes 31 and 31', and of grounded shield cases 32 and 32', and are retained by the side plates 33 and 33' separated each other and with their openings facing each other. The corona electrodes 31 and 31' and the shield cases 32 and 32' are made, respectively, of similar materials to those of the example of FIG. 10. Thus, the corona chargers 36 and 36' form the so-called "double corona" such that the corona electrode 31 is connected to the positive terminal of a first high DC voltage power source 37 whereas the corona electrode 31' is connected to the negative terminal of a second high DC voltage power source 37'. The negative terminal of the first power source 37 and the positive terminal of the second power source 37' are grounded to the earth. The voltages of the two power sources 37 and 37' can be about 5 to 20 KV.

At both sides of the corona chargers 36 and 36', both the roller pairs of the grounding roller 8, which is grounded to the earth through the resistor R, and the grounded conductive roller 40 and of the insulating roller 9, whose surface at least is insulating, and the driving roller 43 are rotatably held by the side plates 33 and 33'. The paired rollers 8 and 40 as well as the paired rollers 9 and 43 are retained by side plates 33 and 33' such that they are in contact with each other or separated from each other at a spacing slightly smaller than the thickness of the electrostatic image forming material 1. If desired, these paired rollers are held under pressure using a conventional pressure means such as coil spring or a leaf spring.

The grounding roller 8 and the insulating roller 9 are made, respectively, of similar materials to those of the embodiment of FIG. 10. The conductive roller 40 and the driving roller 43 are rotated in the direction of the arrow 44 by a suitable drive source (not shown). For the purpose of ensuring transmission of the rotational force to the electrostatic image forming material 1 and for the reason as will be described in the following, the conductive roller 40 desirably has a rigid surface and is elastic. Thus, the conductive roller 40 can have a metal shaft 39 which is covered with a conductive rubber 38. This conductive rubber 38 has an elastic hardness of about 10 to 100 and is molded by mixing natural rubber, butyl rubber (Buna rubber), neoprene, stryene-butadiene rubber (SBR), butyl rubber or silicone rubber with a conductive material such as carbon. The resistance of the conductive rubber is preset at a level lower than about $10^9\Omega$ cm and can preferably be lower than $10^6\Omega$ cm. The driving roller 43 desirably has sufficient elasticity for ensuring treasmission of the rotational force to the electrostatic image forming material 1. This driving roller 43 is, for example, composed of a metal shaft 42 and of a cover 41 which has an elastic hardness of about 10 to 100 and which is made of a rubber material such as natural rubber, Buna, neoprene, SBR, butyl rubber or silicone rubber.

The plane intersecting the centers both of the roller pair of the grounding roller 8 and the conductive roller 40 and of the insulating roller 9 and the driving roller 43 is located in the clearance between the corona chargers 36 and 36'. If desired, the level of the resistance R can be about $10^5$ to $10^9\Omega$ similar to that of the example of FIG. 10. The side plates 33 and 33' are made of a material similar to that of the side plates 13 and 13' of FIG. 10, and are fixed, for instance, to a suitable base plate 45.

The electrostatic image forming material 1 is inserted between the insulating roller 9 and the driving roller 43 in a manner so that its conductive layer portions face the grounding roller 8. Receiving the rotational force of the driving roller 43, the electrostatic image forming material 1 proceeds in the direction of the arrow 35, and in the mean time the electrostatic image forming material is exposed to corona ions, which are emitted from corona electrode 31 and 31' of corona chargers 36 and 36', so that the surface is charged a positive potential and the back face is charged a negative potential. Where the back face of the support 2 is made conductive, the corona charging operation to the back face can be dispensed with. This is because, in this case, negative charges are supplied from the earth to the back face of the support 2 by way of the conductive roller 40.

The electrostatic image forming material 1 thus corona-charged is then passed between the grounding roller 8 and the conductive roller 40. Since, in this instance, the grounding roller 8 is grounded to the earth by way of the resistor R, the charges in the conductive layer portions 4 as shown in FIGS. 1*a* and 1*b* leak to the earth relatively slowly. Thus, the possible discharge between the island-shaped conductive layer portions, which are charged but are to be grounded, and the conductive layer portions, which are grounded to the earth through the resistor R, can be effectively prevented.

Of the charges applied to the back face of the support, on the other hand, those charges which are applied to areas of the back face which correspond to the conductive layer portions 4 or the non-image forming portions are neutralized as a result of contact with the conductive roller 40 which is grounded to the earth. In this instance, for the conductive back face of the support, those particular charges can be neutralized by bringing only one point of the back face into contact with the conductive roller 40. For the insulating back face of the support, on the contrary, it is necessary to bring the conductive roller 40 into contact with the entire area of the back face of the support when the back face is to be grounded. The reason is that, if charges remain in the areas of the back face of the support which correspond to the conductive layer portions 4 or the nonimage portions of FIGS. 1*a* and 1*b*, the charges remaining will invite undesirable results in that the toners are caught by portions other than the image forming portions 3 when it is intended later to subject the obtained electrostatic image to a developing treatment using the toners.

From that reason, it is desirable that no charge be left on the back face of the support except on those areas corresponding to the image forming portions 3. Therefore, the conductive roller 40 desirably has a smooth surface and sufficient elasticity so as to ensure its contact with the back face of the support.

With the above in mind, the provision of a plurality of grounding rollers, each of which is grounded to the earth through a resistor, is found to be effective in increasing the number of contacts so that the grounding operations of the charges in the conductive layer portions can be made remarkably slowly. In this instance, moreover, the resistances of the resistors can preferably be present such the one resistor to be connected with the roller, which first accomplishes the contact, is made to have a sufficiently high resistance and that the resistance of the remainign resistors is successively decreased.

In another apparatus for exemplifying the present invention, moreover, such a grounding roller which is covered with an insulating layer as shown in FIG. 8 can be employed without any difficulty.

Suitable methods in which toners area selectively adhered to the latent electrostatic image formed include dry developing methods such as a cascade developing method, a magnetic brush method, etc. If desired, transfer of the toner image to another substrate or support can be accomplished.

The present invention can also be practiced where the resistor R of the foregoing embodiments is replaced by DC power source such as is shown in FIG. 9.

The following examples are given to illustrate the invention in greater detail. Unless otherwise indicated, all parts, percents, ratios and the like are by weight.

EXAMPLE 1

A copper foil having a thickness of 100 $\mu$ was adhered to the surface of a phenol resin plate having a thickness of 0.8 mm. This copper foil was partially removed using a photo-etching treatment in the form of a desired pattern, thus preparing an electrostatic image forming material. This material was placed on a grounded conductive base plate with its resin plate down. Thus, the remaining copper foil forming the condctive layer portions was electrically isolated from the earth. After that, the electrostatic image forming material was subjected to a charging treatment using a corona charger, upon which a high DC voltage of + 6.5 KV was impressed. Then, a stainless steel roller having a diameter of 20 mm and grounded to the earth through a resistor of $10^8\Omega$ was rolled on the surface of the electrostatic image forming material at a speed of 10 cm/sec. As a result, the potential of the conductive layer portions was completely reduced to zero, and an electrostatic image was formed on the areas of the material surface, from which the copper foil had been removed.

On the contrary, in the case where such a roller as was grounded directly or without a resistor interposed was rolled on the surface of the electrostatic image forming material, the surface potential of the conductive layer portions was also reduced to zero, but some portions of the insulating recesses acting as the image forming portions were found to lose their charges. It was also found after a developing treatment using toners that the lines or letters of the resultant visual image were partially damaged.

EXAMPLE 2

A liquid having the following composition was applied to a film of 100 $\mu$ thickness made of a polyethylene terephthalate resin and the was dried to attain a dried conductive layer of a thickness of 10 $\mu$.

The composition used was:

| | weight parts |
|---|---|
| Nitrocellulose (low visicosity) | 100 |
| Zinc Stearate | 75 |
| Carbon Black | 25 |
| Methyl Acetate | 200 |
| Acetone | 250 |
| Methanol | 100 |
| Phenol-Denaturated Alkyd Resin (Containing 52% of Castor Oil) | 15 |
| Castor-Oil-Denaturated Alkyd Resin (Containing 75% of Castor Oil) | 10 |

The conductive layer portions had a surface resistance of $10^6\Omega/\square$ , and could be removed partially with ease using a scribe-recording stylus.

The conductive surface layer of the material thus fabricated was removed in a pattern-like manner using a scribe-recording stylus so as to prepare the electrostatic image forming material. This material was then placed on the conductive base plate, which was grounded to the earth, with its resin film surface facing the plate. Thus, the conductive layer portions were electrically isolated from the earth. After that, a corona charging operation was applied to the conductive layer portions using a corona charger, upon which a DC voltage of + 5.5 KV was impressed. When a stainless steel roller of a diameter of 20 mm, which was grounded to the earth through a 1 M$\Omega$ resistor, was rolled on the surfaces of the conductive layer portions at a speed of 10 cm/sec, the potentials of all of the conductive layer portions were reduced to zero, and the electrostatic image was formed on the areas, from which the conductive layer portions were removed. It was found that no damage was observed in the electrostatic image thus obtained.

EXAMPLE 3

A liquid to be applied was prepared by eliminating carbon black from the composition of the liquid used in Example 2. The liquid thus prepared was applied to the surface of a similar resin film to that described in Example 2 and then was dried to attain a dried scribe layer of a thickness of 10 $\mu$. Then, aluminium was vacuum-evaporated on the surface of the scribe layer obtained to attain a thickness of 1000 A so that the desired conductive layer was produced. The conductive layer and the scribe-layer were removed in the form of a pattern with use of a scribe-recording stylus so as to prepare the desired electrostatic image forming material. This material thus prepared was then subjected to a corona charging operation by placing the material on a conductive base plate, which was grounded in a similar manner to Example 2. When, a copper roller of a diameter of 30 mm, which was grounded to the earth through a resistor of 100 M$\Omega$, was rolled on the surfaces of the conductive layer portions, an electrostatic image similar to Examples 1 and 2 was formed on the surface areas, from which the scribe layer and the conductive layer were partially removed. In this Example, it was found that no damage took place in the electrostatic image obtained.

EXAMPLE 4

An electrostatic image forming material similar to that described in Example 1 was subjected to a charging operation in a similar manner to that described in Example 1. Then, a brass blade of a thickness of 1 mm, which was grounded to the earth through a resistor of $10^8\Omega$, was moved in contact on the conductive layer portions at a scanning speed of 10 cm/sec. As a result, an electrostatic image was formed on those areas of the electrostatic image forming material, from which the copper foil was partially removed.

EXAMPLE 5

An electrostatic image forming material similar to that described in Example 2 was used and was charged in a similar manner to that of Example 2. The grounding roller was prepared by spray-coating a resistive layer having the following composition on a stainless steel roller of a diameter of 20 mm so that the dried layer had a thickness of about 100 $\mu$.

The composition used was:

| | weight parts |
|---|---|
| Carbon Black | 2 |
| Styrezol No. 4250 (Styrenated Alkyd Resin Produced by Japan Reichold K.K.) | 100 |
| Toluene | 200 |

The measured volume resistivity of the resistive layer obtained was $4.2 \times 10^{10}\Omega$cm. The grounding roller was grounded to the earth, and was rolled on the conductive layer portions at a speed of about 15 cm/sec. As a result, it was found that the charges in the conductive layer portions were removed to provide an electrostatic image without any damage.

EXAMPLE 6

An electrostatic image forming material similar to that described in Example 2 was subjected to a charging operation similar to that of Example 2. The potential of the conductive layer portions was measured to have a level of about + 820 V. Then, a brass plate having a thickness of 2 mm was connected to a power source capable of supplying a potential of about +820 V. This brass plate was then placed on the conductive layer portions. After that, the brass plate was disconnected from the power source and then grounded to the earth. After the brass plate was diconnected from the power source and then grounded to the earth. After the brass plate had been removed from the conductive layer portions, it was found that the potentials all over the conductive layer portions had been reduced to zero. It was also found that the electrostatic image obtained had no damaged portion.

On the contrary, wherre the grounded brass plate was placed on the charged conductive layer portions, it was found that the electrostatic image obtained had been partially damaged.

Although the description given hereinbefore has been with reference to the use of charges having a positive polarity, it goes without saying that the charges employed can have an opposite negative polarity.

While the invention has been described in detail and with reference to specific embodiments thereof, it will be apparent to one skilled in the art that various changes and modifications can be made therein without departing from the spirit and scope thereof.

What is claimed is:

1. An eletrostatic latent image forming method comprising:

uniformly charging the surface of an electrostatic image forming member comprising both (1) surface portions each having an insulating surface and occupying the surface of an insulating support in a pattern-like manner and (2) raised layer portions each having a conductive surface and formed on the remaining areas of the surface of said insulating support, such that the conductive layer portions are electrically isolated from the earth;

grounding the surfaces of the charged conductive layer portions to the earth with a potential difference level being maintained which prevents a possible discharge from occuring between the conductive layer portions, which are being grounded and which are to be grounded, so as to remove the charges therefrom so that the charges in the surfaces of the insulating surface portions remain forming an electrostatic latent image;

said grounding being effecting by connecting a grounding resistor having a resistance of $10^5$ to $10^9$ ohms between the conductive layer portions, which are being grounded, and the earth to provide to the grounding circuit a sufficient time delay so as to maintain said potential difference for a predetermined period of time; and moving the connection of the grounding resistor across said conductive layer portions to sequentially effect the removal of the said charges therefrom.

2. The electrostatic image forming method according to claim 1, wherein the grounding is by impressing a bias voltage between the conductive layer portions, which are being grounded, and the earth to provide to the grounding circuit a sufficient time delay to maintain said potential difference.

3. An electrostatic latent image forming apparatus comprising:

a movable corona charger in a housing for relatively scanning the surface of an electrostatic image forming member comprising both (1) engraved surface portions each having an insulating surface and occupying the surface of an insulating support in a pattern-like manner and (2) raised layer portions eahc having a conductive surface and formed on the remaining areas of the surface of said insulating support and uniformly charging the surface of said electrostatic image forming member which the conductive layer portions are electrically isolated from the earth;

a grounding means arranged behind the corona charger with respect to the moving direction of said corona charger and disposed behind said corona charger and in the same housing therewith so as to contact the embossed conductive layer portions to thereby form a circuit to ground the embossed conductive layer portions to the earth and thereby leaving a latent image on the said engraved surface portions; and time delay means comprising resistive means interposed in the circuit between said conductive layer portions and the earth for maintaining during the grounding operation a sufficient potential difference to prevent a possible discharge from occuring between the conductive layer portions which are being grounded and those conductive layer portions which are to be grounded.

4. The electrostatic image forming apparatus according to claim 3, wherein said time delay means includes a resistor interposed in the circuit between said grounding means and the earth.

5. The electrostatic image forming apparatus according to claim 3, wherein said time delay means includes a resistor interposed in the circuit between said conductive layer portions and said grounding means.

6. The electrostatic image forming apparatus according to claim 3, wherein said grounding means includes a conductive blade movable on said embossed conductive layer portions.

7. The electrostatic image forming apparatus according to claim 3, wherein said grounding means includes a conductive grounding plate adapted to be placed on the surface of said electrostatic image forming material.

8. The electrostatic image forming apparatus according to claim 3, wherein said time delay means includes a bias voltage power source interposed in the circuit between said grounding means and the earth.

9. The electrostatic image forming apparatus according to claim 8, wherein said time delay means further includes a changeover switch disposed in said circuit for selectively connecting said grounding means with either of said power source and the earth.

10. The electrostatic image forming apparatus according to claim 3, wherein said grounding means includes a conductive roller adapted to be rolled on said embossed conductive layer portions.

11. The electrostatic image forming apparatus according to claim 10, wherein said conductive roller includes a resistive layer acting as said time delay means.

* * * * *